US008870591B2

(12) United States Patent
Takakura

(10) Patent No.: US 8,870,591 B2
(45) Date of Patent: Oct. 28, 2014

(54) POWER SUPPLY SYSTEM USING AN ADAPTER WITH A TRANSPARENT MEMBER AND A READING SENSOR

(71) Applicant: Sharp Kabushiki Kaisha, Osaka (JP)

(72) Inventor: Masaki Takakura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 50 days.

(21) Appl. No.: 13/712,508

(22) Filed: Dec. 12, 2012

(65) Prior Publication Data

US 2013/0183851 A1 Jul. 18, 2013

(30) Foreign Application Priority Data

Jan. 13, 2012 (JP) ..... 2012-004646

(51) Int. Cl.
*H01R 3/00* (2006.01)
*H01R 13/46* (2006.01)

(52) U.S. Cl.
CPC ..... *H01R 13/465* (2013.01)
USPC ..... 439/490

(58) Field of Classification Search
CPC ..... H01R 13/465; H01R 13/717; H01R 13/7175; H01R 13/6641
See application file for complete search history.

(56) References Cited

U.S. PATENT DOCUMENTS

| | | | | |
|---|---|---|---|---|
| 3,382,355 | A * | 5/1968 | Prifogle et al. | 362/641 |
| 4,915,639 | A * | 4/1990 | Cohn et al. | 439/188 |
| 5,007,857 | A * | 4/1991 | Wright | 439/490 |
| 5,556,192 | A * | 9/1996 | Wang | 362/276 |
| 6,520,787 | B1 * | 2/2003 | Lott | 439/218 |
| 7,121,707 | B2 * | 10/2006 | Currie et al. | 362/555 |
| 7,220,136 | B1 * | 5/2007 | Green | 439/106 |
| 8,105,106 | B1 * | 1/2012 | Stoddard | 439/490 |
| 8,303,158 | B2 * | 11/2012 | Chien | 362/646 |
| 2005/0101193 | A1 * | 5/2005 | Godard | 439/652 |
| 2011/0207347 | A1 * | 8/2011 | Tsuruta | 439/133 |

FOREIGN PATENT DOCUMENTS

| | | | |
|---|---|---|---|
| JP | 08-235297 | A | 9/1996 |
| JP | 2002-044882 | A | 2/2002 |
| JP | 2003-151702 | | 5/2003 |
| JP | 2006-245983 | | 9/2006 |
| JP | 2011-008498 | A | 1/2011 |
| JP | 2012-010431 | A | 1/2012 |

* cited by examiner

*Primary Examiner* — Chandrika Prasad
(74) *Attorney, Agent, or Firm* — Renner, Otto, Boisselle & Sklar, LLP

(57) ABSTRACT

An identification adapter is provided with a case made of a transparent resin which is able to transmit environment light; a socket which is provided on a predetermined surface of the case and into which a power plug of an electrical device is able to be inserted; an adapter plug which is provided on a surface different from the predetermined surface of the case to apply a current to the power plug of the electrical device via the socket, and able to be inserted into another electrical outlet; and an identification mark which is provided near the adapter plug.

6 Claims, 6 Drawing Sheets

POWER SUPPLY SYSTEM USING AN ADAPTER WITH A TRANSPARENT MEMBER AND A READING SENSOR

CROSS-NOTING PARAGRAPH

This non-provisional application claims priority under 35 U.S.C. §119(a) on Patent Application No. 2012-004646 filed in JAPAN on Jan. 13, 2012, the entire contents of which are hereby incorporated herein by reference.

FIELD OF THE INVENTION

The present invention relates to an identification adapter, a power supply apparatus and a power supply system for supplying electric power to an electrical device.

BACKGROUND OF THE INVENTION

In an office, each staff member is provided with an electrical device such as a personal computer, for example. Electric power from a power supply apparatus is supplied to the electrical device even in standby of the electrical device, so that a larger amount of electric power is consumed in an office compared to an ordinary household.

For lowering power consumption, a method for measuring power consumption of an electrical device to get a staff member to acknowledge a measurement result is effective.

On the other hand, recently, in an office, a sitting room where a staff member does not have a designated seat, which is called a free address, is employed. A staff member is frequently able to move with an electrical device. In order to measure power consumption of an electrical device, it is important to grasp which of power plugs of electrical devices is inserted into which of electrical outlets of power supply apparatuses.

For example, Japanese Laid-Open Patent Publication No. 2006-245983 describes that a power plug of an electrical device is provided with a current sensor and an RFID tag, and a power supply apparatus is provided with a reader/writer. Additionally, a technique has been proposed therein for detecting which of power plugs is inserted into which of electrical outlets.

Incidentally, a power supply apparatus has a structure including a plurality of electrical outlets. The plurality of electrical outlets is close to one another to be inserted into the power supply apparatus. As described in Japanese Laid-Open Patent Publication No. 2006-245983, identification of a power plug with an RFID tag causes interference because of using the same close proximity frequency band. As the result, it becomes difficult to grasp a correspondence relation between the power plug and the electrical outlet, which poses a problem.

SUMMARY OF THE INVENTION

An object of the present invention is to provide an identification adapter, a power supply apparatus and a power supply system capable of grasping a correspondence relation between a power plug and an electrical outlet even in the case of having a structure including a plurality of electrical outlets.

An object of the present invention is to provide an identification adapter comprising: a case made of a transparent resin which is able to transmit environment light; a socket which is provided on a predetermined surface of the case and into which a power plug of an electrical device is able to be inserted; an adapter plug which is provided on a surface different from the predetermined surface of the case to apply a current to the power plug of the electrical device via the socket, and able to be inserted into another electrical outlet; and an identification mark which is provided near the adapter plug.

Another object of the present invention is to provide the identification adapter, wherein the identification mark is provided between the adapter plugs arranged together as a set.

Another object of the present invention is to provide a power supply apparatus for identifying the identification adapter, comprising: a housing in which a plurality of electrical outlets are formed; and a reading sensor that is provided for each of the electrical outlets in the housing and provided near the electrical outlet.

Another object of the present invention is to provide the power supply apparatus, wherein the reading sensor is provided between the electrical outlets arranged together as a set.

Another object of the present invention is to provide a power supply system in which the adapter plug of the identification adapter is electrically connected to the electrical outlet of the power supply apparatus, wherein the power supply apparatus is provided with a correspondence grasping portion for specifying the identification adapter that is electrically connected to the electrical outlet based on a reading result of the identification mark by the reading sensor.

Another object of the present invention is to provide the power supply system, wherein the power supply apparatus is provided with an electrical power measurement portion for measuring power consumption of the electrical device, and the correspondence grasping portion acquires information of power consumption that is consumed in the electrical device.

Another object of the present invention is to provide the power supply system, wherein the power supply apparatus is provided with a radio communication portion for transmitting an acquisition result of the correspondence grasping portion by means of a radio signal.

PREFERRED EMBODIMENTS OF THE INVENTION

Figure 1:
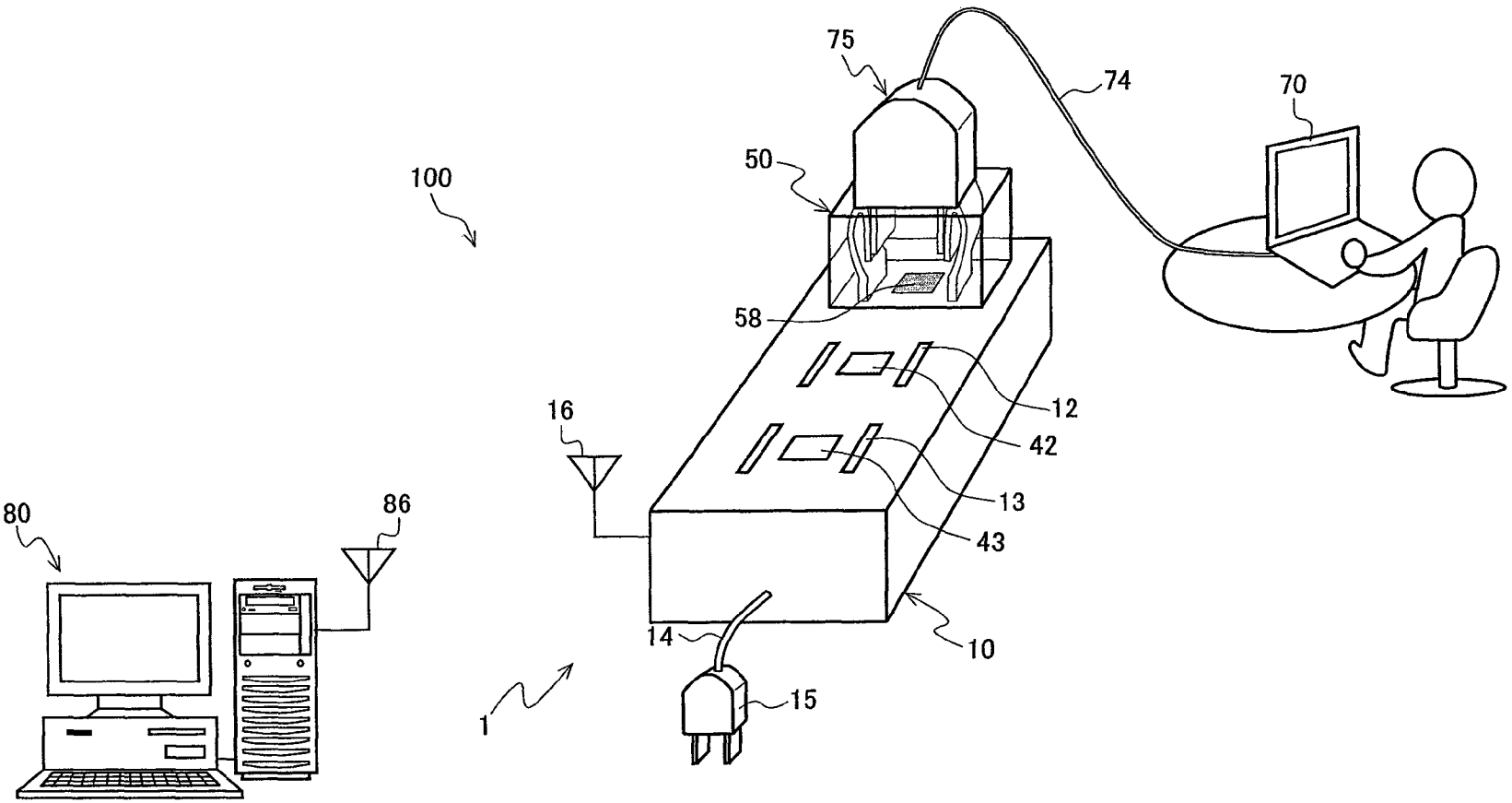
FIG. 1 is a view explaining a use situation of an identification adapter and a power supply apparatus of the present invention.
Figure 2:
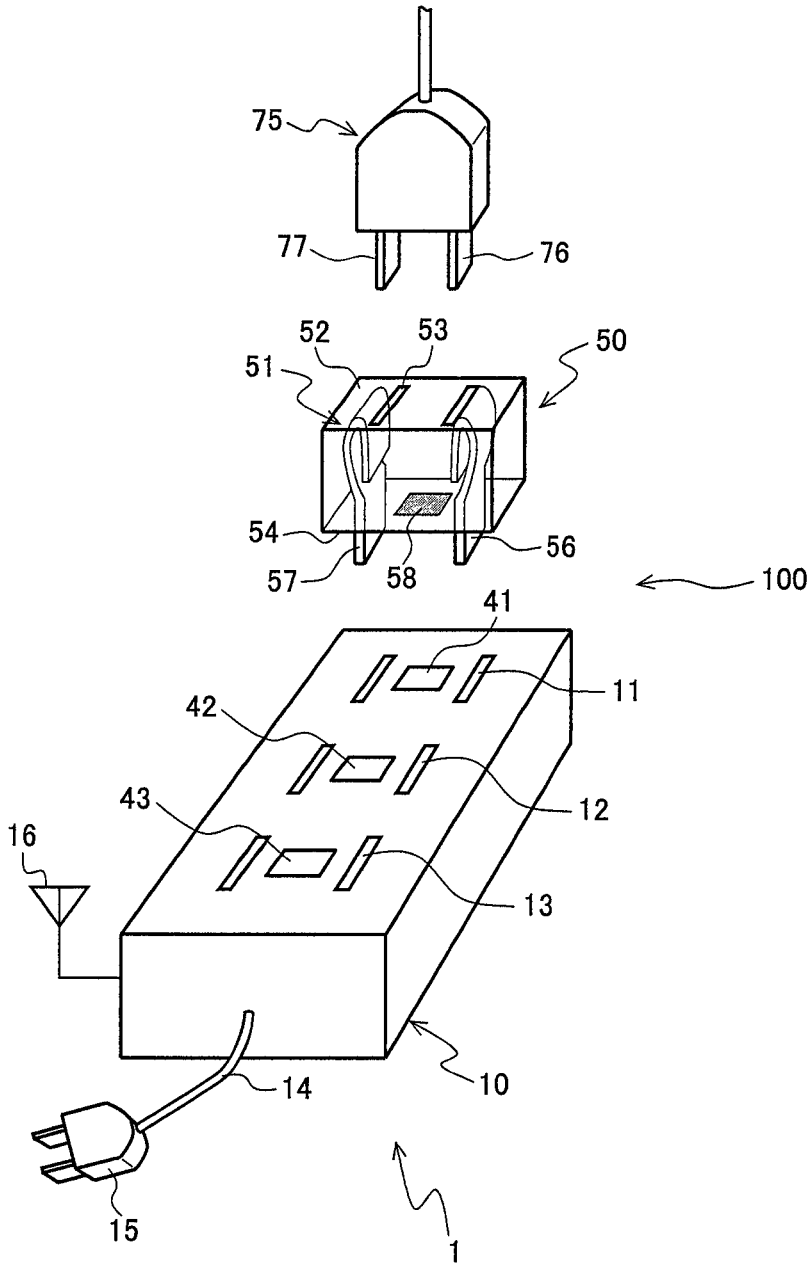
FIG. 2 is a view explaining a structure of the identification adapter and the power supply apparatus of the present invention.

Hereinafter, a power supply system of the present invention will be described with reference to drawings. FIG. 1 is a view explaining a use situation of an identification adapter and a power supply apparatus of the present invention, and FIG. 2 is a view explaining a structure of the identification adapter and the power supply apparatus of the present invention.

A power supply system 100 is comprised of a power supply tap 1 and an identification adapter 50. The power supply tap 1 is provided with a cuboid housing 10. An electric power line 14 is pulled out from an end part of the housing 10 in a longitudinal direction. A tip of the electric power line 14 is provided with, for example, a 2-prong power plug 15. The plug 15 is connected to commercial power supply. Note that, the power supply tap 1 corresponds to the power supply apparatus of the present invention.

The housing 10 includes, for example, a radio antenna 16. The power supply tap 1 is able to transmit/receive a signal to/from a power management apparatus 80 via the radio antenna 16 and a radio antenna 86.

For example, three electrical outlets 11, 12 and 13 in total are formed in the housing 10 having approximately equal intervals. Note that, the outlets 11, 12 and 13 correspond to other electrical outlets of the present invention.

Each of the electrical outlets 11, 12 and 13 is configured, for example, in a 2-prong type, in which a single outlet includes a set of two long holes and electrodes. This set of long holes forms a socket of the outlet. Adapter blades 56 and 57 of the identification adapter 50, or device blades 76 and 77 of a power plug 75 are able to be inserted into the outlets 11, 12 and 13. Note that, the adapter blades 56 and 57 of the identification adapter 50 correspond to adapter plugs of the present invention.

Reading sensors 41, 42 and 43 are installed in the outlets 11, 12 and 13, respectively. Each of the reading sensors 41, 42 and 43 includes a photoelectric conversion element such as photodiode linearly or areally arranged. The reading sensor converts shading of an image which is formed on a light receiving surface to be acquired into an electrical signal, and reads the image by applying the predetermined image processing to the electrical signal. Note that, the reading sensor is only needed to be able to detect a mark 58 described below and may have any method. For example, a bar code, a two-dimensional bar code, a detector which is able to detect a simple monochrome pattern, or an image sensor such as a CCD may be allowed. It is only necessary to be able to distinguish among several types of numerical values and character information.

The sensor 41 adapts to the outlet 11, and is provided near the outlet, for example, in an intermediate position of a socket of the outlet 11. The sensor 42 adapts to the outlet 12, and is provided, for example, in an intermediate position of a socket of the outlet 12. The sensor 43 adapts to the outlet 13, and is provided, for example, in an intermediate position of a socket of the outlet 13.

The identification adapter 50 is provided with a cuboid case 51. The case 51 has a size in which three identification adapters 50 do not interfere with one another even in the case of being inserted into all the outlets 11, 12 and 13.

The case 51 is formed of, for example, a transparent resin capable of transmitting environment light. Note that, the transparent resin transmits light, for which a flame-resistant material having voltage proof is selected.

The case 51 has an upper surface 52 on which an electrical outlet 53 into which the power plug 75 of an electrical device 70 is able to be inserted, and a lower surface 54 from which each of the adapter blades 56 and 57 protrudes. The outlet 53 has a socket formed by a set of two long holes, for example. The device blades 76 and 77 are allowed to be inserted into the case 51 from the outlet 53. The outlet 53 corresponds to a socket of the present invention.

The outlet 53 has 2-prong adapter blades 56 and 57, for example. Upper end parts of the adapter blades 56 and 57 are allowed to be electrically connected to the device blades 76 and 77 inside the case 51.

Figure 3A:
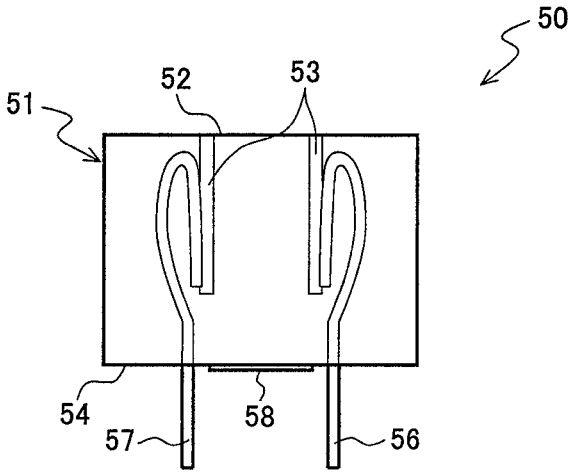
FIG. 3A and FIG. 3B are a side view and a bottom view of the identification adapter of the present invention.
Figure 3B:
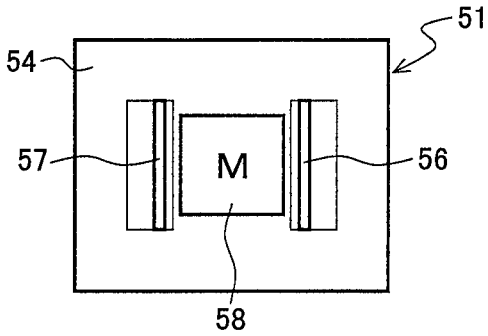

FIG. 3A and FIG. 3B are a side view and a bottom view of the identification adapter of the present invention. As shown in FIG. 3A, lower end parts of the adapter blades 56 and 57 protrude from the case 51 and are allowed to be electrically connected to one electrical outlet.

As shown in FIG. 3B, the identification mark 58 is installed on the lower surface 54 of the identification adapter 50. In a case where the identification mark 58 is read by any reading sensor, the identification adapter 50 is identified.

The mark 58 is formed having an area approximately equivalent to a layout area of the reading sensor. The mark 58 is attached near the adapter blades 56 and 57, for example, to an intermediate position between the adapter blades 56 and 57 on the lower surface 54, that is, a position facing the reading sensor when the identification adapter 50 is inserted into one electrical outlet. Ina case where a power plug of an electrical device which is connected to the identification adapter 50 is recognized, the mark 58 of the identification adapter 50 plays a role for specifying the power plug of the electrical device. The reading sensor reading the mark 58 plays a role for specifying an outlet of a power supply tap which is inserted into the identification adapter 50.

The identification mark 58 is provided having a different content for each identification adapter 50, and in the mark 58 shown in FIG. 3B, for example, an alphabetic capital "M" is indicated.

Note that, the mark is only needed to face the reading sensor and may be provided in any position on the lower surface 54. The mark may have a pattern or the like indicating a vertical position. The mark may be a character, a figure, a symbol or a combination thereof, a pattern in which black is combined with a transparent color, a pattern in which black is combined with white, or the like, in addition to a bar code.

Environment light around the outlet illuminates the identification mark 58 from behind, and the reading sensor uses a change in a light volume of environment light which is transmitted through the case 51 to read the mark 58.

When the identification adapter 50 is not inserted into an outlet of a power supply tap, the reading sensor is able to detect illuminance around the outlet. Such a detection result is able to be used for criteria of judgment at the time of reading by the reading sensor, for example, on whether to have brightness capable of reading the mark 58, and the like, and contributes to improvement of identification accuracy of the identification adapter 50 and a power plug.

Figure 4:
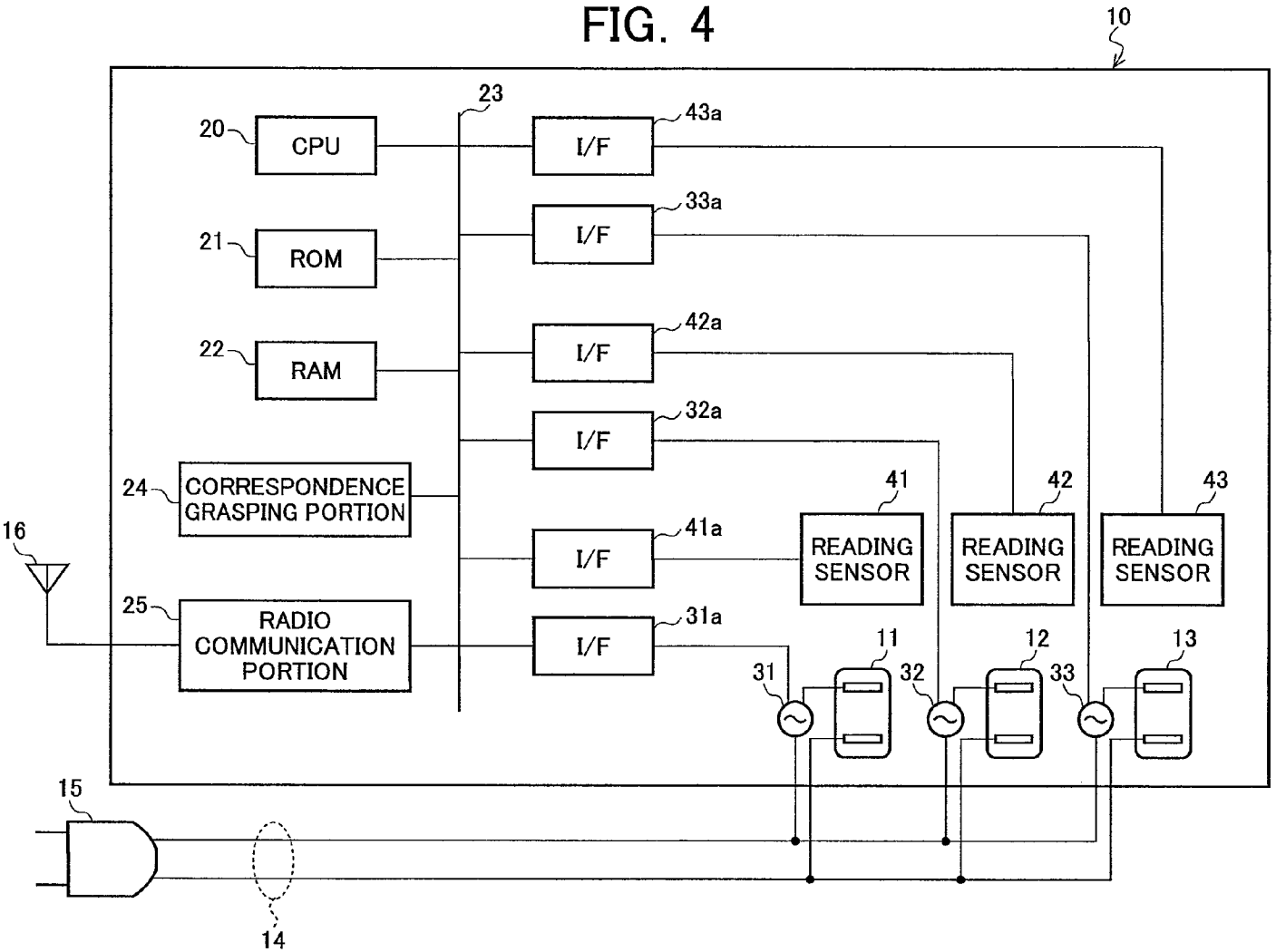
FIG. 4 is a block diagram of the power supply apparatus of the present invention.

FIG. 4 is a block diagram of the power supply apparatus of the present invention, which is a view explaining a structure of the inside of the housing 10.

Inside the housing 10, electrodes of the electrical outlets 11, 12 and 13 are electrically connected to ammeters 31, 32 and 33, respectively. The ammeter 31 is able to measure electric power supplied to an electrical device via the electric power line 14 and the outlet 11 from the power plug 15 connected to a commercial power supply. The ammeter 32 is able to measure electric power supplied to an electrical device via the electric power line 14 and the outlet 12 from the plug 15, and the ammeter 33 is able to measure electric power supplied to an electrical device via the electric power line 14 and the outlet 13 from the plug 15, respectively. Note that, the ammeters 31, 32 and 33 correspond to electric power measurement portions of the present invention.

The ammeters 31, 32 and 33 are connected to an internal bus 23 through interface portions 31*a*, 32*a* and 33*a*. The reading sensors 41, 42 and 43 are connected to the internal bus 23 through the interface portions 41*a*, 42*a* and 43*a*.

To the bus 23, a CPU (Central Processing Unit) 20, a ROM (Read Only Memory) 21 and a RAM (Random Access Memory) 22 are also connected. The CPU 20 reads in the RAM 22 and executes a program that is stored in the ROM 21, followed by execution of electric power measurement processing described below.

To the bus 23, a correspondence grasping portion 24 and a radio communication portion 25 are also connected. The correspondence grasping portion 24 specifies an identification adapter that is electrically connected to the electrical outlets 11, 12 and 13 based on a reading result of a mark of the identification adapter by the reading sensors 41, 42 and 43. Then, in combination with information of a power plug of an electrical device that is connected to the identification adapter 50, the grasping portion 24 acquires information such that which of power plugs of electrical devices is inserted into which of three outlets 11, 12 and 13. The grasping portion 24 also acquires from the ammeters 31, 32 and 33 information of power consumption that is consumed in an electrical device.

An acquisition result of the correspondence grasping portion 24 is output to the radio communication portion 25. The radio communication portion 25 transmits information of power consumption of an electrical device and the like to the power management apparatus 80 of FIG. 1 via the antenna 16.

Information of power consumption of an electrical device is able to be provided for a user, thereby making it possible to facilitate use not exceeding rated power supply capacity in addition to facilitating of power saving. Further, in a case where transmission to a power management apparatus is performed by means of radio, a small wiring range is only needed for transmitting the acquisition result of the grasping portion 24 to the outside.

Figure 5:
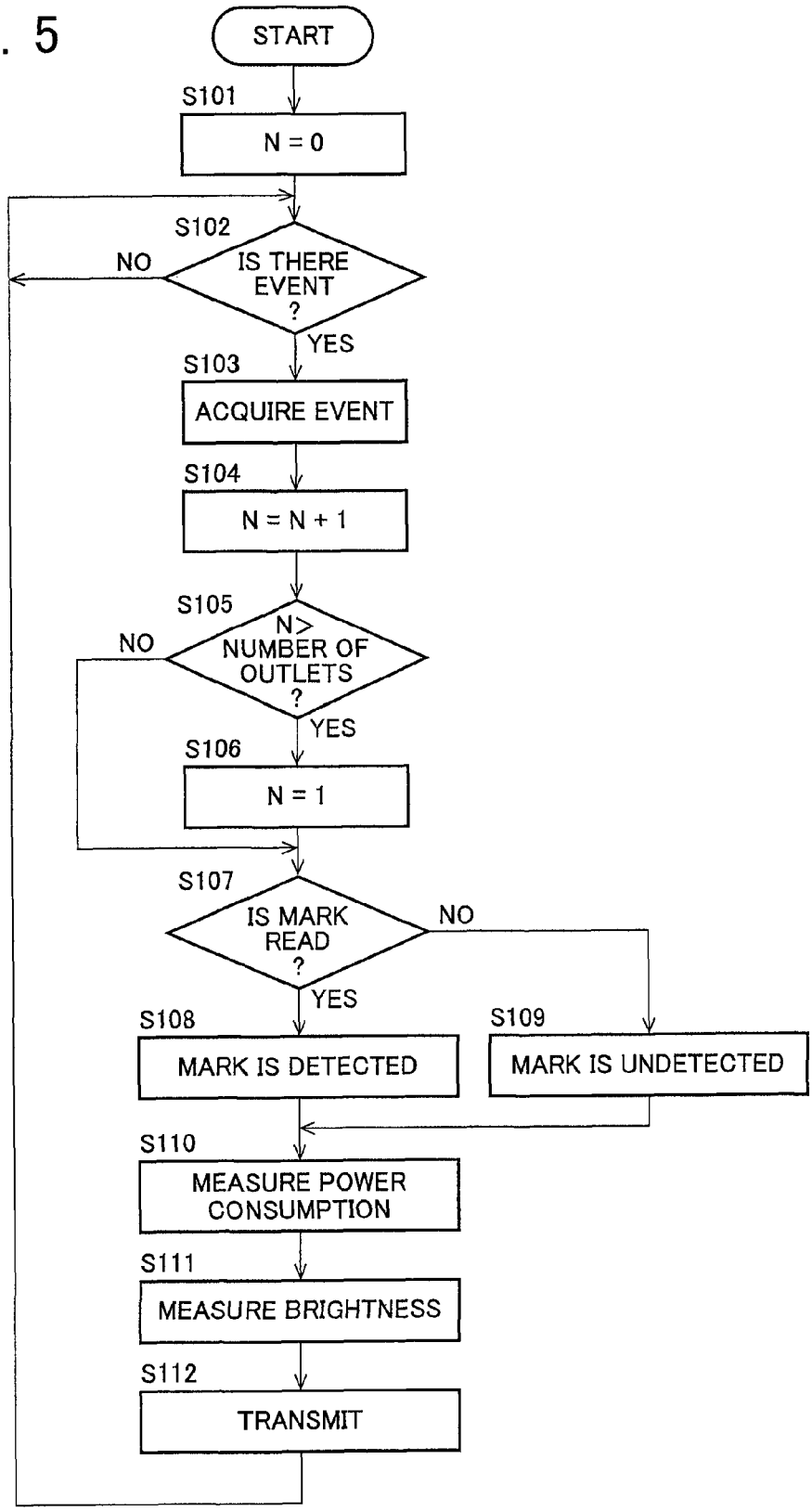
FIG. 5 is a flowchart explaining electric power measurement by the power supply apparatus of the present invention.

FIG. 5 is a flowchart explaining electric power measurement by the power supply apparatus of the present invention.

The correspondence grasping portion 24 sets an outlet number N to 0 at step S101, and determines whether or not to have an event at step S102.

The radio communication portion 25 accepts an instruction to start measurement of power consumption and the like from the power management apparatus 80 and the like as an example of an event (YES at step S102), and when the grasping portion 24 acquires a content of the instruction (step S103), the process goes to step S104.

The grasping portion 24 adds 1 to a previous outlet number N to set a new outlet number N (step S104). The new outlet number N shows an electrical outlet as a target for measurement this time.

Subsequently, at step S105, the grasping portion 24 determines whether or not the new outlet number N at step S104 exceeds the number of outlets of a power supply tap, and in the case of not exceeding the number of the outlets (NO at step S105), the process goes to step S107 immediately.

On the other hand, in the grasping portion 24, when the above-described new outlet number N exceeds the number of the outlets (YES at step S105), the process goes to step S106 to set the new outlet number N to 1, thereafter going to step S107.

At step S107, the grasping portion 24 determines whether or not a reading sensor of the electrical outlet to be measured this time is able to read a mark of an identification adapter.

When the reading sensor located in the target for measurement this time is able to read an identification mark, the process goes to step S108. The grasping portion 24 acquires a character of the mark and the like, and the process goes to step S110. On the other hand, when the reading sensor is not able to read the mark, the process goes to step S109. In this case, the grasping portion 24 judges that the mark is undetected, and the process thereafter goes to step S110.

At step S110, an ammeter located in the target for measurement this time measures power consumption of an electrical device. Then, at step S111, the reading sensor located in the target for measurement this time measures illuminance around the outlet. Measurement results of the power consumption of the electrical device and the illuminance around the outlet are output to the grasping portion 24.

The grasping portion 24 outputs the acquired measurement results in addition to the character of the mark of the identification adapter to the radio communication portion 25. The communication portion 25 transmits the results to the power management apparatus 80 (step S112), and the process returns to step S102.

Thereafter, the communication portion 25 accepts from the power management apparatus 80 a message that information of the electrical outlet corresponding to the outlet number this time is acquired, as an example of an event (YES at step S102), and when the grasping portion 24 acquires a content of the message (step S103), the process goes to step S104. Then, the grasping portion 24 acquires information of an electrical outlet corresponding to a next outlet number.

Figure 6A:
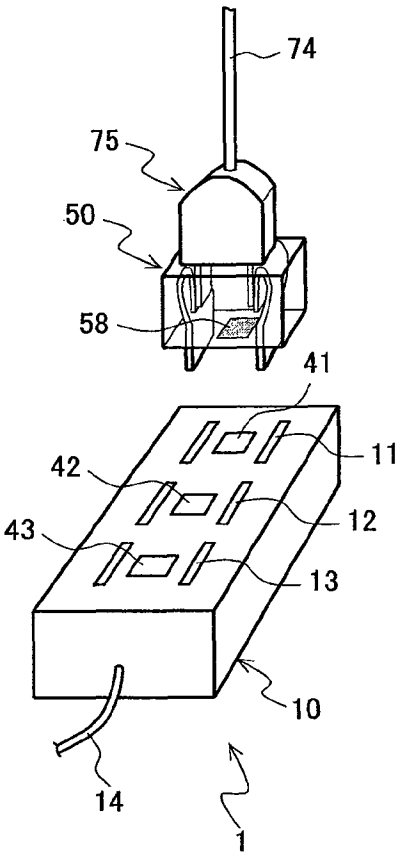
FIG. 6A to FIG. 6C are views explaining connection of the identification adapter to the power supply apparatus of the present invention.
Figure 6B:
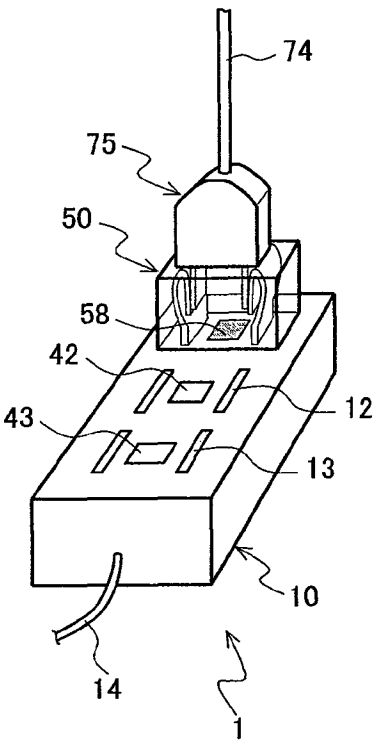
Figure 6C:
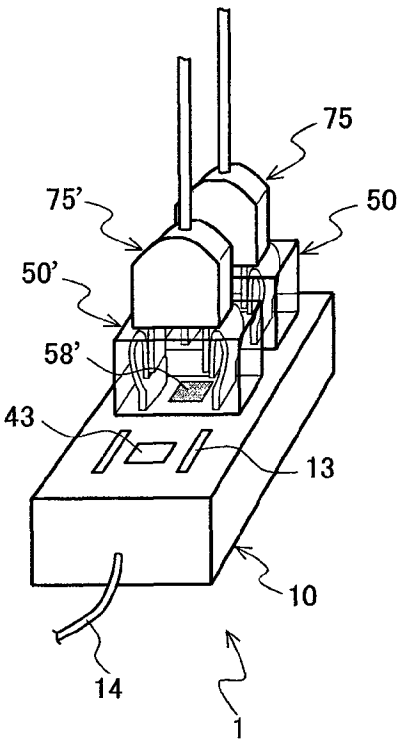

FIG. 6A to FIG. 6C are views explaining connection among the identification adapter and the power supply apparatus of the present invention, and a power plug. A staff member having an electrical device sits in any seat of a sitting room, and inserts the power plug 75 of the electrical device into the identification adapter 50 as shown in FIG. 6A.

Then, as shown in FIG. 6B, when the staff member inserts the identification adapter 50 into, for example, the outlet 11 of the power supply tap 1, electric power from commercial power supply is supplied to the electrical device of the staff member via the outlet 11. At the same time, the mark 58 of the identification adapter 50 faces the reading sensor 41 of the electrical outlet 11.

Note that, the identification adapter 50 may be inserted into the outlet 11 in advance to thereafter insert the plug 75 into the identification adapter 50.

When the identification adapter 50 is inserted into the outlet 11, as shown in FIG. 6C, a power plug 75' of another electrical device is electrically connected to another identification adapter 50', and when the identification adapter 50' is inserted into the outlet 12, electric power from commercial power supply is allowed to be supplied also to the another electrical device via the outlet 12. At the same time, a mark 58' of the identification adapter 50' faces the reading sensor 42 of the outlet 12.

Note that, for the above-described outlet number N explained in FIG. 5, electric power measurement processing will be described below, assuming that the outlet number N=1 corresponds to the outlet 11, the outlet number N=2 corresponds to the outlet 12, and the outlet number N=3 corresponds to the outlet 13, respectively, in the power supply tap 1.

First, the grasping portion 24 acquires from the radio communication portion 25, for example, an event that measurement of power consumption is started. The grasping portion 24 uses the outlet number N (=0) at step S101 to set a new outlet number N (=1) for setting a target for measurement to the outlet 11 (step S104).

Since the new outlet number N (=1) does not exceed the number of the outlets (=3) of the power supply tap 1 (NO at step S105), the process goes to step S107 immediately.

In a case where the reading sensor 41 of the outlet 11 to be measured this time is able to read the mark 58 of the identification adapter 50, the process goes to step S108. The grasping portion 24 acquires a character "M" of the mark 58, and the process goes to step S110.

The ammeter 31 measures power consumption P11 of an electrical device that is electrically connected to the outlet 11 (step S110). The sensor 41 measures darkish illuminance L11 obstructed by the mark 58 (step S111). Measurement results of the power consumption P11 and the illuminance L11 of the electrical device are output to the grasping portion 24.

The radio communication portion 25 transmits to the power management apparatus the outlet 11 specified by the sensor 41, and the power consumption P11 and the illuminance L11 of the electrical device having the plug 75 specified by the identification mark 58 in addition to the character "M" of the mark 58 (step S112).

Subsequently, the grasping portion 24 acquires from the communication portion 25, for example, an event that information of the outlet 11 is acquired. The grasping portion 24 uses a previous outlet number N (=1) to set a new outlet number N (=2) (step S104) for setting a target for measurement to the outlet 12. Note that, since the new outlet number N (=2) has not yet exceeded the number of the outlets (=3) of the power supply tap 1 (NO at step S105), the process goes to step S107 immediately.

Here, when the sensor 42 of the outlet 12 to be measured this time is able to read the identification mark 58' of the identification adapter 50', the process goes to step S108. Then, the grasping portion 24 acquires, for example, "01" in which characters are combined as the mark 58', which illustration is omitted, and the process goes to step S110.

The ammeter 32 measures power consumption P12 of another electrical device that is electrically connected to the outlet 12 (step S110). The sensor 42 measures darkish illuminance L12 obstructed by the mark 58' (step S111).

In a case where a main power supply switch of the another electrical device that is electrically connected to the outlet 12 is turned off, power consumption P12 becomes 0. In this case, the communication portion 25 transmits to the power management apparatus the outlet 12 specified by the sensor 42, and the power consumption P12 (=0) and the illuminance L12 of the another electrical device having a power plug 75' specified by the identification mark 58' in addition to the above-described "01" of the mark 58' (step S112).

In this manner, when the identification adapters 50 and 50' are electrically connected to both the outlets 75 and 75' and the outlets 11 and 12, the correspondence grasping portion 24 specifies the outlets 11 and 12 electrically connected to the plugs 75 and 75', respectively, based on a change in a light volume of light obstructed by the identification marks 58 and 58', so that conventional interference does not occur along with radio communication that is used for identification of power plugs. Therefore, in the case of being integrated with information of a relation of connection between each of the plugs 75 and 75' and each of the identification adapters 50 and 50', even in the case of having a plurality of outlets 11, 12 and 13, it is possible to grasp a correspondence relation between a plug of an electrical device and an outlet of a power supply tap.

Thereafter, the grasping portion 24 acquires from the communication portion 25, for example, an event that information of the outlet 12 is acquired. The grasping portion 24 uses a previous outlet number N (=2) to set a new outlet number N (=3) for setting a target for measurement to the outlet 13 (step S104). Since the new outlet number N (=3) also has not yet exceeded the number of outlets (=3) of the power supply tap 1 (NO at step S105), the process goes to step S107 immediately.

However, as shown in FIG. 6C, the identification adapter is not inserted into the outlet 13. The sensor 43 is not able to read an identification mark (NO at step S107), and the grasping portion 24 regards the mark as undetected (step S109).

The ammeter 33 measures power consumption P13 concerning the outlet 13. The sensor 43 measures illuminance L13 which corresponds to a circumference of the outlet 13 and is brighter than detection values of the sensors 41 and 42 (step S110, step S111).

As the result, the communication portion 25 transmits to the power management apparatus the outlet 13 specified by the sensor 43, undetectability of a mark, the power consumption P13 (=0) and the illuminance L13 (step S112).

Subsequently, the grasping portion 24 acquires from the radio communication portion 25, for example, an event that information of the outlet 13 is acquired. The grasping portion 24 uses a previous outlet number N (=3) to set a new outlet number N (=4) (step S104).

In this case, at step S105, the new outlet number N (=4) exceeds the number of outlets (=3) of the power supply tap 1 (YES at step S105). The grasping portion 24 goes to step S106 to set a new outlet number N=1 for setting a target for measurement to the outlet 11.

As the result, the grasping portion 24 is able to acquire information of the outlet 11 again. The grasping portion 24 subsequently repeats acquisition of information in order of the outlets 12 and 13, further in order of the outlets 11, 12 and 13, thereby making it possible to grasp a correspondence relation between a power plug and an electrical outlet all the time.

Note that, even in a case where an identification adapter is electrically connected to both a power plug and an electrical outlet, a reading sensor is not able to read a mark of the identification adapter in a state where a light of a sitting room where a power supply tap is arranged is turned off. In this case, the correspondence grasping portion judges that the mark is undetected, and the ammeter measures power consumption of the electrical device and the reading sensor measures, for example, illuminance of brightness 0, respectively. However, when the identification adapter is continued to be electrically connected to the electrical outlet even at the time of turning on the light of the sitting room, the mark is able to be read at the stage.

In the above-described embodiment, has the power supply apparatus is described by an analogy to a power supply tap. However, the power supply apparatus of the present invention is of course able to be applied also to a wall socket embedded in a wall surface of a sitting room, as long as a plurality of electrical outlets is provided.

Additionally, the power supply apparatus of the present invention may measure power consumption of an electrical device with an ammeter outside a housing. The power supply apparatus may transmit an acquisition result of the correspondence grasping portion to the power management apparatus by wire communication.

As described above, according to the present invention, the identification adapter is identified using an identification mark. Therefore, in the case of connecting the identification adapter to a power plug of an electrical device, the power plug becomes identifiable without using conventional radio communication. Further, when a reading sensor reads an identification mark, it becomes possible to specify an electrical outlet that is electrically connected to the power plug, so that conventional interference does not occur along with radio communication. Therefore, even in the case of having a plurality of electrical outlets, it is possible to grasp a correspondence relation between a power plug of an electrical device and an electrical outlet of a power supply apparatus via the identification adapter.

The invention claimed is:

1. A power supply system comprising:

an identification adapter comprising:

a case made of a transparent resin which is configured to transmit environment light, a socket which is provided on a predetermined surface of the case and configured for a power plug of an electrical device to be inserted onto the socket, an adapter plug configured to be inserted into an electrical outlet and which is provided on a surface different from the predetermined surface of the case to apply a current to the power plug of the electrical device via the socket, and configured to be inserted into another electrical outlet, and an identification mark which is provided near the adapter plug; and a power supply apparatus for identifying the identification adapter of which the adapter plug is electrically connected to an electrical outlet of the power supply apparatus, the power supply apparatus comprising:

a housing in which a plurality of electrical outlets are formed, and a reading sensor that is provided for each of the electrical outlets in the housing and provided adjacent the electrical outlet of the power supply apparatus, wherein the reading sensor uses a change in a light volume of environment light which is transmitted through the case to read the identification mark.

2. The power supply system of claim 1, wherein the identification adapter includes two or more adapter plugs, and the identification mark is provided between the adapter plugs arranged together as a set.

3. The power supply as defined in claim 1, wherein the reading sensor is provided between at least two of the electrical outlets arranged together as a set.

4. The power supply system of claim 1, wherein the power supply apparatus is provided with a correspondence grasping portion for specifying the identification adapter that is electrically connected to the electrical outlet based on a reading result of the identification mark by the reading sensor.

5. The power supply system as defined in claim 4, wherein the power supply apparatus is provided with an electrical power measurement portion for measuring power consumption of the electrical device, and the correspondence grasping portion acquires information of power consumption that is consumed in the electrical device.

6. The power supply system as defined in claim 4, wherein the power supply apparatus is provided with a radio communication portion for transmitting an acquisition result of the correspondence grasping portion by means of a radio signal.

* * * * *